US010767504B2

(12) United States Patent
Martin, Jr. et al.

(10) Patent No.: US 10,767,504 B2
(45) Date of Patent: Sep. 8, 2020

(54) FLEXIBLE DAMPER FOR TURBINE BLADES

(71) Applicant: Siemens Aktiengesellschaft, Munich (DE)

(72) Inventors: Nicholas F. Martin, Jr., York, SC (US); David J. Wiebe, Orlando, FL (US)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 160 days.

(21) Appl. No.: 16/066,700

(22) PCT Filed: Jan. 12, 2016

(86) PCT No.: PCT/US2016/012990
§ 371 (c)(1),
(2) Date: Jun. 28, 2018

(87) PCT Pub. No.: WO2017/123206
PCT Pub. Date: Jul. 20, 2017

(65) Prior Publication Data

US 2019/0017402 A1 Jan. 17, 2019

(51) Int. Cl.

| | |
|---|---|
| ***F01D 11/00*** | (2006.01) |
| ***F01D 5/22*** | (2006.01) |
| ***F01D 5/30*** | (2006.01) |

(52) U.S. Cl.
CPC ..... *F01D 11/006* (2013.01); *F01D 5/22* (2013.01); *F01D 5/3007* (2013.01); *F05D 2230/51* (2013.01)

(58) Field of Classification Search
CPC ..... F01D 5/22; F01D 5/3007; F01D 11/006; F05D 2230/51
See application file for complete search history.

(56) References Cited

U.S. PATENT DOCUMENTS

| | | | | |
|---|---|---|---|---|
| 3,887,298 | A | 6/1975 | Hess et al. | |
| 4,028,006 | A | 6/1977 | Kuroda et al. | |
| 4,257,743 | A | 3/1981 | Fujii | |
| 7,252,477 | B2 * | 8/2007 | Tomita | F01D 5/081 416/145 |
| 8,920,112 | B2 * | 12/2014 | Ring | F01D 25/04 415/119 |

(Continued)

FOREIGN PATENT DOCUMENTS

| | | | |
|---|---|---|---|
| CN | 1534166 | A | 10/2004 |
| CN | 101313129 | A | 11/2008 |
| DE | 102006005056 | A1 | 8/2006 |

(Continued)

OTHER PUBLICATIONS

PCT International Search Report and Written Opinion dated Sep. 7, 2016 corresponding to PCT Application No. PCT/US2016/012990 filed Jan. 12, 2016.

*Primary Examiner* — Moshe Wilensky
*Assistant Examiner* — Christopher R Legendre

(57) ABSTRACT

A flexible damper (24) for turbine blades (10) includes a plurality of segments (32) positioned together in a substantially linear pattern, each segment (32) having a first side (46), a second side (48), a top side (50), a bottom side (52), a length (56), a width (54), and a thickness (58).

13 Claims, 4 Drawing Sheets

(56) References Cited

U.S. PATENT DOCUMENTS

| | | | | |
|---|---|---|---|---|
| 9,194,238 | B2 * | 11/2015 | Roberts, III | F01D 5/3084 |
| 2019/0017402 | A1 * | 1/2019 | Martin, Jr. | F01D 5/3007 |

FOREIGN PATENT DOCUMENTS

| | | | |
|---|---|---|---|
| EP | 2738353 | A2 | 6/2014 |
| JP | S49120901 | U | 10/1974 |
| JP | S5185011 | A | 7/1976 |
| JP | S5449405 | U | 4/1979 |
| JP | S54125307 | A | 9/1979 |
| JP | S54132011 | A | 10/1979 |
| JP | S54135906 | A | 10/1979 |

* cited by examiner

View A-A

View B-B

View C-C

View D-D

View E-E

FLEXIBLE DAMPER FOR TURBINE BLADES

BACKGROUND

1. Field

The present invention relates to gas turbine engines, and more specifically to a flexible damper for a turbine blade.

2. Description of the Related Art

In an axial flow industrial gas turbine engine, hot compressed gas is produced. The hot gas flow is passed through a turbine and expands to produce mechanical work used to drive an electric generator for power production. The turbine generally includes multiple stages of stator vanes and rotor blades to convert the energy from the hot gas flow into mechanical energy that drives the rotor shaft of the engine.

A combustion system receives air from a compressor and raises it to a high energy level by mixing in fuel and burning the mixture, after which products of the combustor are expanded through the turbine.

Gas turbines are becoming larger, more efficient, and more robust. Large blades and vanes are being utilized, especially in the hot section of the engine system. Hot gas path turbine blades may employ some form of damping to manage vibratory excitations during operation. The most common configuration is a straight pin with constant cross-section.

The damper pins need to be properly aligned and manufactured within specified tolerances in order to make eventual contact once the turbine blades are rotating at a certain speed. The turbine damper pins are used for the purpose of damping blade mechanical vibrations. The damper pins can work well when the damper pin slot machining tolerances are small for both surface finish and straightness as well as the small relative position tolerance between adjacent blades. When the surface finish is poor, or the slot is not straight, or the adjacent blade position is off, then the damping and sealing functions of the damper pin are diminished.

Continuous contact between the damper and slots of the blades is a serious issue for a curved root attached turbine blade. A single piece, solid curved damper has a problem that if it rotates even slightly in its groove it can only contact the blade at its ends and at a point in the middle and can have virtually no contact for most of the length of the damper. The centrifugal forces acting on the curved damper will not be distributed in a straight line, instead, will be distributed around the curvature which can cause the damper to have a tendency to tilt and thereby lose most of its contact with the blades.

SUMMARY

In one aspect of the present invention, a flexible damper for turbine blades comprises: a plurality of segments positioned together in a substantially linear pattern, each segment comprising a first side, a second side generally opposite the first side, a top side, a bottom side, a length, a width, and a thickness.

In another aspect of the present invention, a rotor assembly comprises: a disc comprising a plurality of elongated channels provided therein and spaced along a disc periphery and a plurality of disc posts, each positioned between each channel; a plurality of turbine blade airfoils, each comprising a trailing edge and a leading edge joined by a pressure side and a suction side to provide an outer surface extending from a platform in a radial direction to a tip, wherein each turbine blade airfoil is installed in each of the elongated channels on the disc; and a plurality of flexible dampers each comprising a plurality of segments, each segment comprising a first side, a second side generally opposite the first side, a top side, a bottom side, a length, a width, and a thickness; wherein each damper is removably placed into a slot in between each pair of blades.

In another aspect of the present invention, a method for attaching dampers to a rotor assembly comprises: installing a plurality of turbine blades onto a disc comprising a plurality of elongated channels provided therein and spaced along a disc periphery, wherein the plurality of turbine blades each comprises an airfoil, a trailing edge, and a leading edge joined by a pressure side and a suction side to provide an outer surface extending in a radial direction to a tip, wherein a plurality of turbine blades are installed in each of the elongated channels on the disc, removably attaching a plurality of flexible dampers, each damper comprising a plurality of segments, each segment comprising a first side, a second side, a top side, a bottom side, a length, a width, and a thickness.

These and other features, aspects and advantages of the present invention will become better understood with reference to the following drawings, description and claims.

BRIEF DESCRIPTION OF THE DRAWINGS

The invention is shown in more detail by help of figures. The figures show preferred configurations and do not limit the scope of the invention.

DETAILED DESCRIPTION

Figure 1:
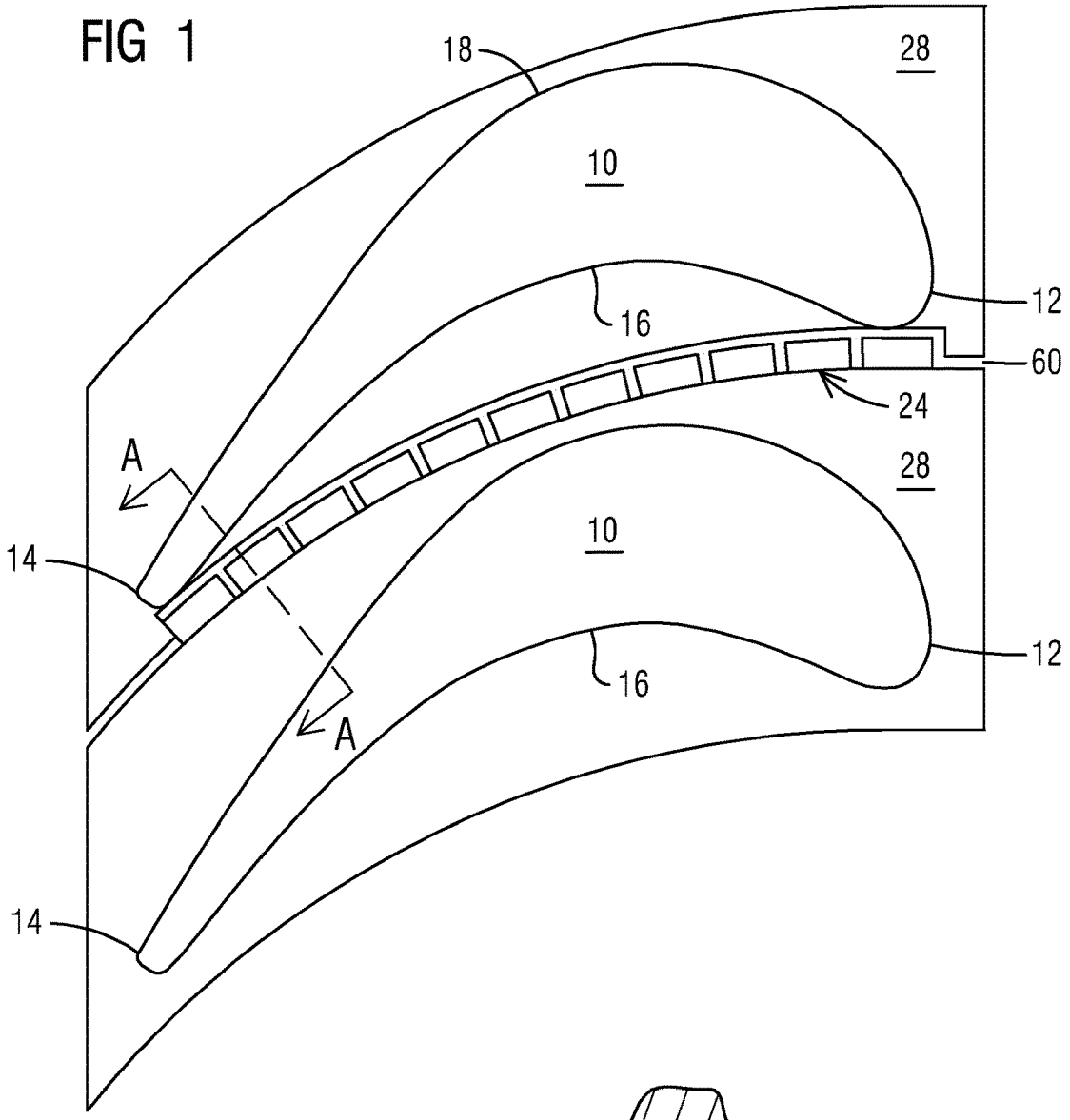
FIG. 1 is a top perspective view of a flexible damper in between two blades.
Figure 2:
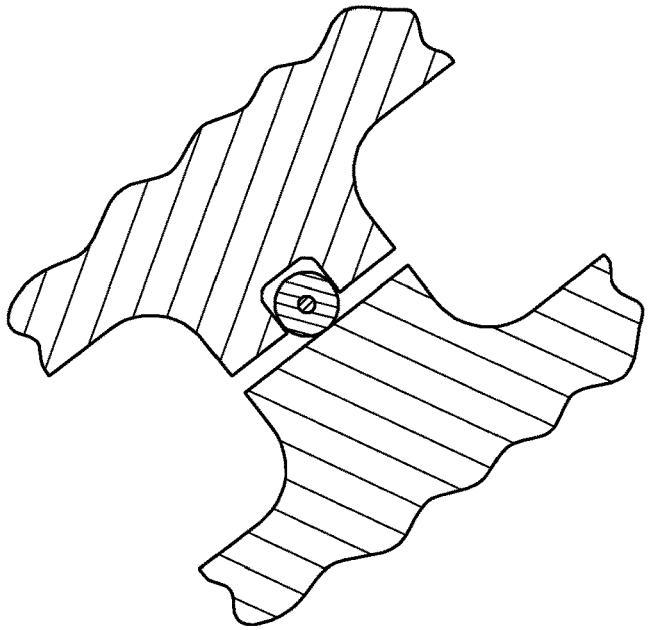
FIG. 2 is a cross-sectional view of a flexible damper in between blades in an embodiment of the invention.
Figure 3:
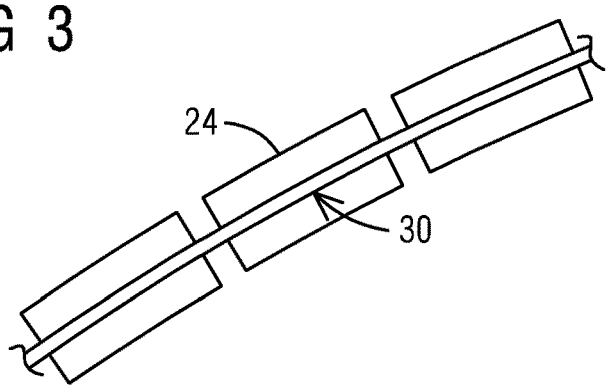
FIG. 3 is a perspective view of a flexible damper with embedded wire of an embodiment of the invention.

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Broadly, an embodiment of the present invention provides a flexible damper for turbine blades includes a plurality of segments positioned together in a substantially linear pattern, each segment including a first side, a second side, a top side, a bottom side, a length, a width, and a thickness.

A gas turbine engine may comprise a compressor section, a combustor and a turbine section. The compressor section compresses ambient air. The combustor combines the compressed air with a fuel and ignites the mixture creating combustion products comprising hot gases that form a working fluid. The working fluid travels to the turbine section. Within the turbine section are circumferential rows of vanes and blades, the blades being coupled to a rotor. Each pair of rows of vanes and blades forms a stage in the turbine section. The turbine section comprises a fixed turbine casing, which houses the vanes, blades and rotor. A blade of a gas turbine receives high temperature gases from a combustion system in order to produce mechanical work of a shaft rotation.

A damper may be introduced in between blades in order to help with damping vibrations of the blades and sealing leakage flows between blades. Damping is an important benefit that a damper may provide for a turbine blade. The damping occurs when there is direct contact and relative movement between adjacent blades and the damper. An aspect of the level of damping is a contact surface. The contact surface is the area of contact between each component. Another phenomena that occurs once the blades are at a certain rotational speed, is that there is radial growth of the airfoil as well as an untwisting at operating conditions. During this process the leakage flow between adjacent blade surfaces needs to be limited. A damper, in this case, may also provide a sealing function for the blades.

Continuous contact between the damper and blades is a serious issue for a curved root attached turbine blade. A single piece, solid curved damper has a problem that if it rotates even slightly in its groove it can only contact the blade at its ends and at a point in the middle and can have virtually no contact for most of the length of the damper. The centrifugal forces acting on the curved damper will not be uniformly distributed in a straight line, instead, will be distributed around the curvature which can cause the damper to have a tendency to tilt and thereby lose most of its contact with the blades.

The traditional solid damper will not stay in contact with a curved root blade and will be ineffective. An increase in contact with all components is desirable. Embodiments of the present invention provide a segmented damper that is flexible. The flexible damper, as will be discussed in detail below, will provide improved contact between blades with increased contact along the length of the damper providing increased dampening and sealing features.

As is shown in FIGS. 1 through 10, a turbine blade 10 may have an airfoil. The turbine blade 10 may be referred to as the airfoil, or turbine blade airfoil. The turbine blade airfoil 10 may include a trailing edge 14 and a leading edge 12 joined by a pressure side 16 and a suction side 18 to provide the outer surface 20 extending from a platform 28 in a radial direction to a tip (not shown). A damper 24 may be a separate component that may be removably inserted between adjacent blades 10 in an assembled wheel (not shown), with the wheel having a plurality of removably inserted blades. The wheel may include a disc having a plurality of elongated channels spread along the disc periphery. The blades are inserted within these channels. In between the plurality of channels may be a plurality of disc posts 26. A slot 60 may be formed by adjacent blade platforms 28 and the disc post 26 positioned between the blades 10.

Each turbine blade includes the platform 28, the airfoil, and the blade root. In certain embodiments, the blade 10 may have a curved root. In other embodiments, the blade 10 may have a conventional straight root. The airfoil extends outward in a first direction from the platform 28 forming the leading edge 12, the trailing edge 14, the pressure side 16, and the suction side 18. Each turbine blade 10 is then installed in the turbine disc, with the airfoil extending outward away from the platform 28. The pressure side 16 spans between the leading edge 12 and the trailing edge 14 with a concave shape. The suction side 18 is opposite the pressure side 16 and spans between the leading edge 12 and the trailing edge 14 with a convex shape.

Figure 4:
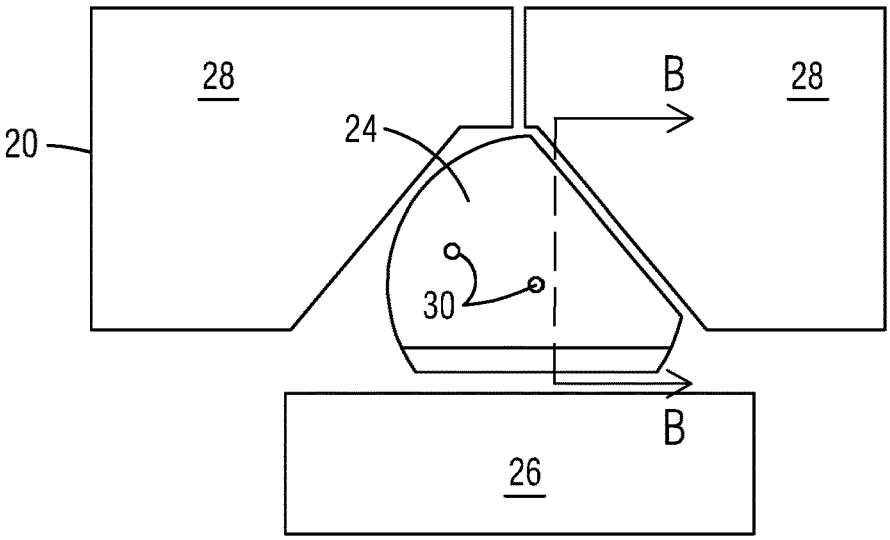
FIG. 4 is a side view of an airfoil assembly according to an exemplary embodiment of the invention.
Figure 5:
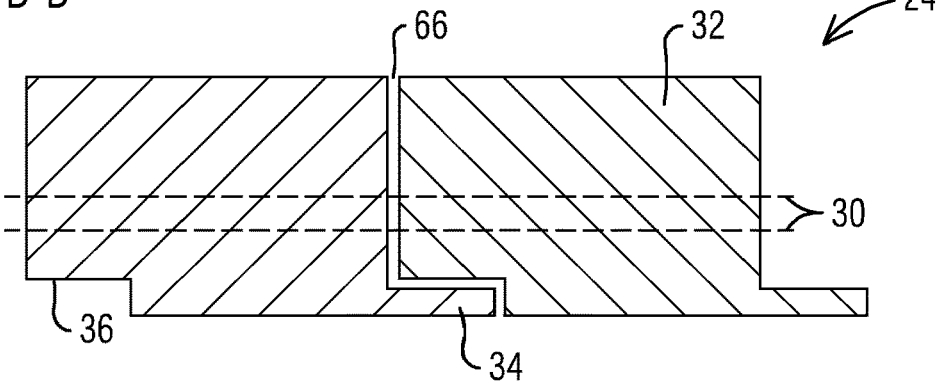
FIG. 5 is a cross-sectional view of a portion of the flexible damper and blades taken along the section line B-B in FIG. 4.
Figure 6:
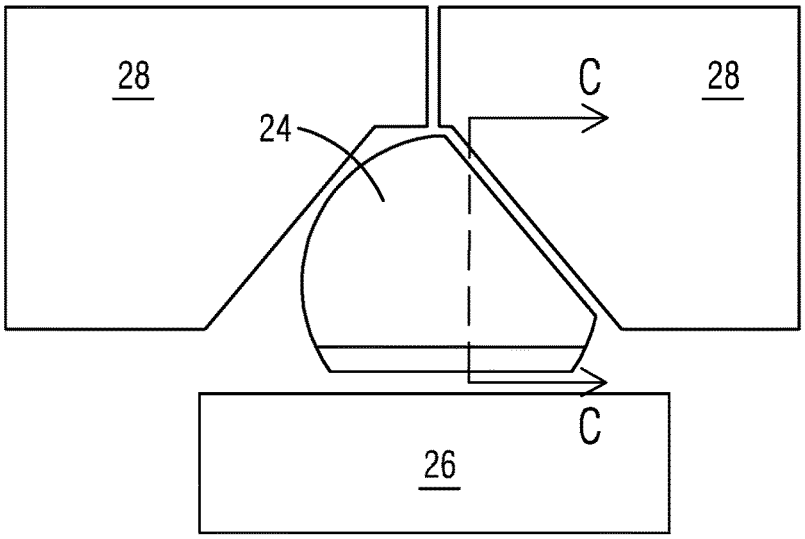
FIG. 6 is a side view of an airfoil assembly according to an exemplary embodiment of the present invention.
Figure 7:
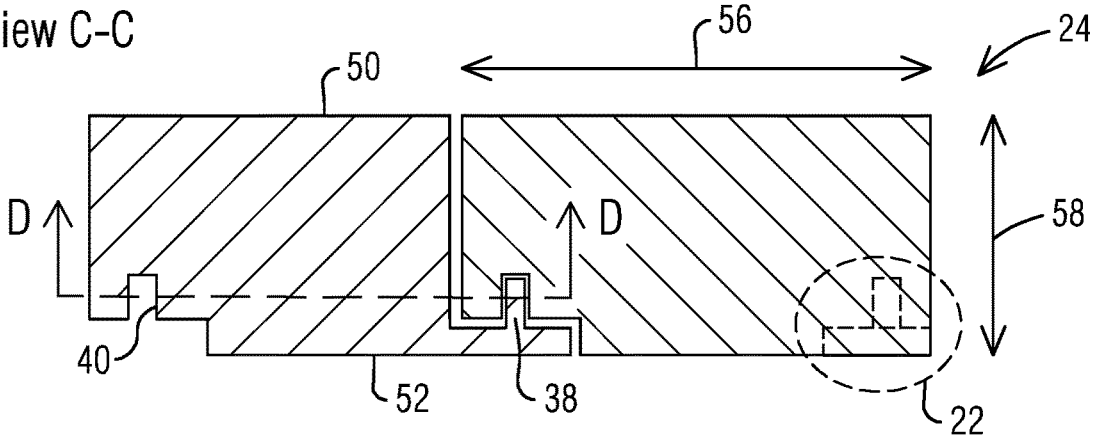
FIG. 7 is a cross-sectional view of a portion of the flexible damper and blades taken along the section line C-C in FIG. 6.
Figure 8:
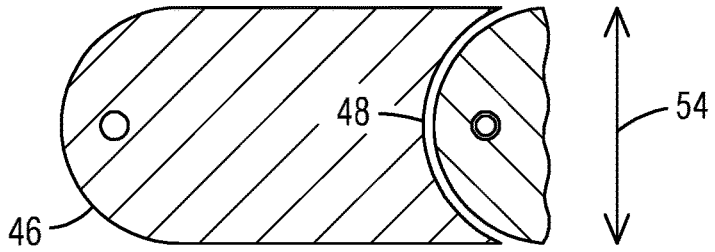
FIG. 8 is a cross-sectional view of a portion of the flexible damper taken along the section line D-D in FIG. 7.
Figure 9:
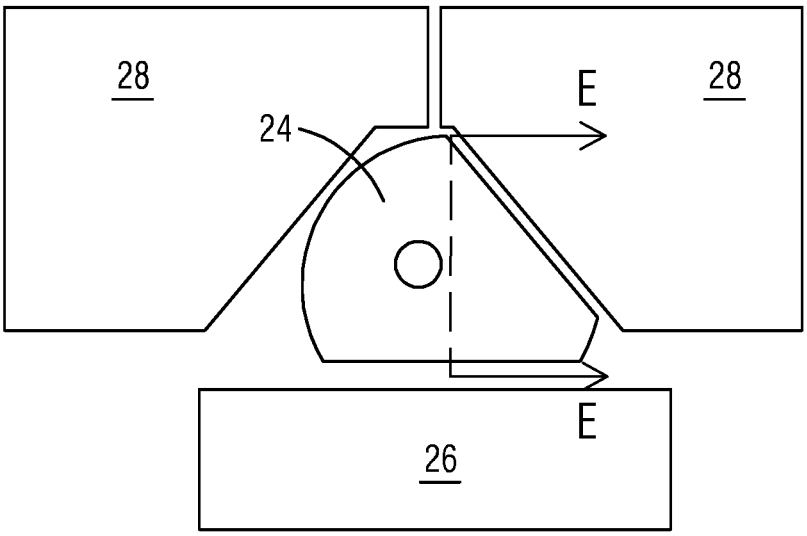
FIG. 9 is a side view of an airfoil assembly according to an exemplary embodiment of the invention.
Figure 10:
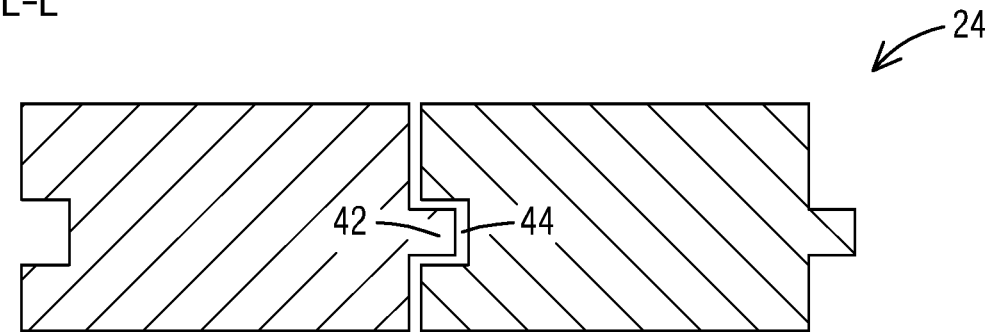
FIG. 10 is a cross-sectional view of a portion of the flexible damper and blades taken along the section line E-E in FIG. 9.

The damper 24 includes a plurality of segments 32. The flexibly of the damper may be provided by the plurality of segments 32 strung together piece-wise in substantially linear segments. Each segment 32 may include a first side 46, a second side 48, a top side 50, a bottom side 52, a length 56, a thickness 58, and a width 54. The plurality of segments may be placed into a slot 60 that is formed between two adjacent blade platforms 28 and a disc post 26. In certain embodiments, each segment 32 may include an inter-segment (32) linkage mechanism 22. The linkage mechanism 22 may be at least one embedded wire 30, a radial pin connector 38 and a radial loose fit hole 40, an axial pin connector 42 and an axial loose fit hole 44, or the like. In certain embodiments, multiple parallel embedded wires 30 may be used to connect each segment 32 as is shown in FIGS. 4 and 5. The linkage mechanism 22 may further connect and provide sealing functions in between each segment 32 within the slot 60.

Each segment may also include in certain embodiments an extended portion 34 along one side and a cutout portion 36 along the same side on an opposite end, wherein the extended portion 34 of one segment 32 overlaps the cutout portion 36 of a next connected segment 32.

The plurality of segments 32 may have one of several different shapes in order to fit an application. The plurality of segments 32 may have a predominately rectangular shape, have both straight edges and curves, tubular, or the like. The size and shape of each segment 32 may be determined by mechanical and aerodynamic requirements such as the size of the slot 60, the contact surface for damping, and the airfoil radial growth and untwist at operating conditions. The plurality of segments 32 is shown with several different shapes throughout the Figures listed. The cross-section of the damper 24 is circular in FIG. 2, however, the damper 24 can be any shape that may be required for the slot geometry and damping characteristics.

As mentioned above, the plurality of blades 10, may be placed and installed on the wheel. The wheel may include a rotating disc. The disc may include a plurality of elongated channels provided therein and spaced along a disc periphery. Each of the blades 10 may be installed in each of the elongated channels on the disc. In between the plurality of blades 10 may define a slot 60, having a slot length and a slot width between each blade 10. The disc post 26 may be positioned between each blade 10. The disc post 26 may sit underneath the platform 28 of each blade 10. The damper 24 may be supported by the slot 60 formed by the disc post 26 and the blades 10. The damper 24 may have a variable length 56, a variable thickness 58, and a variable width 54 in the slot 60 along a circumferential direction. The damper 24 may have a variable tangential camber within the slot 60.

The plurality of segments may each be of different length 56, a different width 54 or different thickness 58 along the slot 60 depending on the shape of the blades 10. The damper thickness 58, damper length 56 and damper width 54 are within the slot width and slot length as defined by the space between the blades 10 and disc post 26.

With each damper 24, there may be a clearance gap 66 to prevent binding during blade movement such as untwist and radial growth. The blade 10 may be allowed to be free to untwist and grow radially without any restriction, or binding, from the damper 24.

In all embodiments, blade 10 to blade 10 contact is maintained for all operating speeds. There is no need for special tools in order to properly set and assemble the plurality of dampers 24 in place for proper contact. The plurality of blades 10 may be placed in the wheel, and each damper 24 may be placed into each damper slot 60. Once each damper 24 is placed into damper slot 60, there is blade 10 to blade 10 contact. The blade 10 to blade 10 contact may be maintained at all operating speeds. Therefore, damping may be available at all operating speeds. This is especially true for curved root attached turbine blades.

Servicing of the blades 10 and damper 24 may improve with the ability to change out the removably attached segments 32. Differently shaped segments 32 may be placed in service to update or improve performance of the turbine. A flexible damper 24 with the plurality of segments 32 can replace a standard damper in an existing design. The easy replacement of segments 32 may allow for an increase in damping and sealing of the blades 10. Additionally, each segment 32 may have a different cross-section in order to optimize the damping along the curved path.

The damper 24 may slide into the slot 60 in certain embodiments. In certain embodiments, the damper 24 may be loaded in with a blade 10 and then the next blade 10 may be loaded. In certain embodiments, the damper 24 may be loaded once both adjacent blades 10 have been loaded. The damper 24 may also be loaded prior to the blades 10 being loaded. In more well defined slots 60, there may be no need to include a linkage mechanism 22 such as wiring of the plurality of segments 32. The slot 60 can be of any shape. The damper 24 may be of any shape to conform best with the slot shape.

A flexible damper 24 may have the ability to manage variation in slot machining tolerances, surface finish, and blade-to-blade positioning. The slot machining tolerances need not be small for the damper 24 to fit within the slot 60. However, a damper 24 with a plurality of segments 32 may be able to be positioned within a slot 60 without linkage mechanisms 22 and function properly if the slot is well enough defined. The damper 24 may be improved with the linkage mechanisms 22 in place along the plurality of segments 32. The plurality of segments 32 may be able to locally fit and adjust along the length of the slot 60 to provide the contact against the blades 10 as well as provide sealing against leakage. The segment shapes may be retrofitted into existing designs. The flexible damper 24 may increase the ability to damp and seal curved root attached turbine blades 10.

The plurality of segments 32 may be capable of managing the pathway of the slot 60 and positional tolerances in a conventional straight slot as well as the curved slot required by a curved root attached blade 10.

As mentioned above, the size and shape of each damper 24 may be determined by mechanical and aerodynamic requirements. The cross sectional width or diameter of the damper 24 may be sized to provide more (or less) contact surface or more (or less) weight which provides more (or less) centrifugal force/damping friction. Since the damper 24 is in a plurality of segments 32 it is possible for the damper 24 to have different cross sectional dimensions at different locations along its length so that more (or less) damping may be achieved at different locations so the damping may be tailored to meet the needs of the application. An example may be if after an engine run it is discovered that more damping is needed at the leading edge 12 but not at the trailing edge 14. The contact surface for damping and sealing may be increased with the flexible damper 24 able to conform to the spacing of the damper slot.

Optimization may occur with proper testing of the turbine. A flexible damper may provide multiple methods to dampen during operation and seal between blade surfaces. There may be two or more segment 32 configurations distributed in the slot 60 in order to interfere with coupled blade-to-blade vibration.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

What is claimed is:

1. A flexible damper for turbine blades comprising:

a plurality of segments positioned together in a substantially linear pattern, each segment comprising a first side, a second side generally opposite the first side, a top side, a bottom side, a length, a width, and a thickness, wherein each segment comprises an extended portion and a cutout portion along the bottom side, wherein the extended portion of one segment of the plurality of segments overlaps the cutout portion of another segment of the plurality of segments next to the one segment.

2. The flexible damper according to claim 1, wherein a clearance gap exists between adjacent segments of the plurality of segments.

3. The flexible damper according to claim 1, wherein the extended portion comprises a radial pin connector, and the cutout portion comprises a radial loose fit hole, wherein the radial pin connector of the one segment removably engages with the radial loose fit hole of the another segment.

4. The flexible damper according to claim 1, wherein each segment comprises an axial pin connector on the first side and an axial loose fit hole along the second side, wherein the axial pin connector of one segment the of the plurality of segments engages with the axial loose fit hole of another segment of the plurality of segments next to the one segment.

5. The flexible damper according to claim 1, wherein each of the plurality of segments is connected by at least one embedded wire.

6. The flexible damper according to claim 1, wherein cross sectional dimensions of the plurality of segments vary at different locations along the length of the damper.

7. A rotor assembly comprising:

a disc comprising a plurality of elongated channels provided therein and spaced along a disc periphery and a plurality of disc posts, each disc post positioned between each channel;

a plurality of turbine blades, each turbine blade comprising an airfoil having a trailing edge and a leading edge joined by a pressure side and a suction side to provide an outer surface extending from a platform in a radial direction to a tip, wherein each turbine blade airfoil is installed in each of the elongated channels on the disc; and a plurality of flexible dampers each comprising a plurality of segments, each segment comprising a first side, a second side generally opposite the first side, a top side, a bottom side, a length, a width, and a thickness;

wherein each damper is removably placed into a slot in between adjacent blades of the plurality of blades, and wherein each segment comprises an extended portion and a cutout portion along the bottom side, wherein the extended portion of one segment of the plurality of segments overlaps the cutout portion of another segment of the plurality of segments next to the one segment.

8. The rotor assembly according to claim 7, wherein a clearance gap exists between adjacent segments of the plurality of segments.

9. The rotor assembly according to claim 7, wherein the extended portion comprises a radial pin connector, and the cutout portion comprises a radial loose fit hole, wherein the radial pin connector of the one segment removably engages with the radial loose fit hole of the another segment.

10. The rotor assembly according to claim 7, wherein each of the segments comprises an axial pin connector on the first side and an axial loose fit hole along the second side, wherein the axial pin connector of one segment of the plurality of segments engages with the axial loose fit hole of another segment of the plurality of segments next to the one segment.

11. The rotor assembly according to claim 7, wherein each of the plurality of segments is connected by at least one embedded wire.

12. The rotor assembly according to claim 7, wherein cross sectional dimensions of the plurality of segments vary at different locations along the length of the damper.

13. A method for attaching dampers to a rotor assembly comprising:

installing a plurality of turbine blades onto a disc comprising a plurality of elongated channels provided therein and spaced along a disc periphery, wherein the plurality of turbine blades each comprise an airfoil, a trailing edge and a leading edge joined by a pressure side and a suction side to provide an outer surface extending in a radial direction to a tip, wherein the plurality of turbine blades are installed in each of the elongated channels on the disc, removably attaching the dampers, each damper comprising a plurality of segments, each segment comprising a first side, a second side generally opposite the first side, a top side, a bottom side, a length, a width, and a thickness, wherein each segment comprises an extended portion and a cutout portion along the bottom side, wherein the extended portion of one segment of the plurality of segments overlaps the cutout portion of another segment of the plurality of segments next to the one segment.

* * * * *